US009553374B1

(12) United States Patent
Murugiah

(10) Patent No.: US 9,553,374 B1
(45) Date of Patent: Jan. 24, 2017

(54) ELECTRICAL CONNECTORS AND CONNECTION ASSEMBLIES AND METHODS INCLUDING THE SAME

(71) Applicant: Tyco Electronics Canada ULC, Markham (CA)

(72) Inventor: Sachidanandan Murugiah, Stouffville (CA)

(73) Assignee: Tyco Electronics Canada ULC, Markham (CA)

( * ) Notice: Subject to any disclaimer, the term of this patent is extended or adjusted under 35 U.S.C. 154(b) by 0 days.

(21) Appl. No.: 14/946,011

(22) Filed: Nov. 19, 2015

(51) Int. Cl.
*H01R 4/36* (2006.01)
*H01R 43/16* (2006.01)

(52) U.S. Cl.
CPC ..... *H01R 4/36* (2013.01); *H01R 43/16* (2013.01)

(58) Field of Classification Search
USPC ..... 439/814, 798, 797, 801, 625, 810, 740,439/789
See application file for complete search history.

(56) References Cited

U.S. PATENT DOCUMENTS 1,409,817 A * 3/1922 Bilterman ..... F16B 39/023 411/259
1,901,159 A 3/1933 Guest
3,641,865 A 2/1972 Swindt et al.
4,161,619 A * 7/1979 Markarian ..... H05B 7/14 373/91
4,184,408 A 1/1980 Smith et al.
4,214,806 A * 7/1980 Kraft ..... H01R 4/302 174/72 R
4,382,651 A * 5/1983 Klosin ..... H01F 27/40 439/272
4,659,267 A 4/1987 Uno et al.
4,696,423 A 9/1987 Ryan
(Continued)

FOREIGN PATENT DOCUMENTS

EP 0319610 A1 6/1989
EP 1933043 A1 6/2008
GB 2299640 A 10/1996

OTHER PUBLICATIONS

"De Strain Clamp, Studs, Other Accessories", LaPrairie Electrical Products, Date Unknown but prior to Nov. 18, 2014, 2 pages.
(Continued)

*Primary Examiner* — Alexander Gilman
(74) *Attorney, Agent, or Firm* — Myers Bigel, P.A.

(57) ABSTRACT

According to embodiments of the invention, an electrical connector for use with an electrical conductor having a terminal end includes a connector body and a stud member. The connector body includes a conductor engagement section and a stud mounting section. The conductor engagement section is configured to receive the terminal end of the conductor to mechanically and electrically connect the conductor to the connector. The stud mounting section includes a socket bore including a tapered bore section. The stud member includes an elongate stud section extending to a free end, and a tapered insertion section. The tapered insert section is received in the tapered bore section. The tapered insert section includes an internal cavity defined therein to permit deformation of the tapered insert section as the tapered insert section is forced into the tapered bore section.

19 Claims, 5 Drawing Sheets

(56) References Cited

U.S. PATENT DOCUMENTS 4,740,166 A * 4/1988 Barnhouse ..... H01R 12/585 439/751
4,890,965 A * 1/1990 Dietlein ..... F16B 39/36 411/280
4,967,168 A * 10/1990 Bacher ..... H01P 1/045 333/125
5,092,797 A 3/1992 Cole et al.
5,201,914 A * 4/1993 Hollick ..... H01R 4/36 439/801
5,366,391 A * 11/1994 Deiss ..... H01R 13/422 439/740
5,630,737 A * 5/1997 Dupont ..... H01R 4/26 439/431
5,634,312 A 6/1997 Tolliver et al.
5,690,516 A * 11/1997 Fillinger ..... H01R 11/01 439/798
5,704,748 A * 1/1998 Criswell ..... F16B 39/34 411/299
5,713,708 A * 2/1998 Van derDrift ..... F16B 39/32 411/208
5,810,530 A 9/1998 Travis
5,944,563 A * 8/1999 Nagafuji ..... H01R 12/585 439/751
6,042,430 A 3/2000 Hollick
6,109,850 A 8/2000 Commins
6,116,942 A * 9/2000 Chen ..... F16B 35/02 411/271
6,146,188 A 11/2000 Snyder
6,579,131 B1 * 6/2003 Ashcraft ..... H01R 4/36 439/798
6,655,464 B2 * 12/2003 Chau ..... E21B 17/003 166/380
6,764,354 B2 7/2004 Kaine et al.
6,815,616 B1 * 11/2004 King, Jr. ..... H01R 4/22 174/87
6,827,520 B2 12/2004 Reichartz
6,939,183 B2 * 9/2005 Ferretti ..... H01R 4/36 439/798
7,074,064 B2 * 7/2006 Wallace ..... E21B 17/028 166/65.1
7,214,108 B2 5/2007 Barnett
7,416,454 B2 * 8/2008 Tamm ..... H01R 4/36 439/775
7,520,786 B2 * 4/2009 Triantopoulos ..... H01R 11/09 439/798
7,845,977 B2 * 12/2010 Cook ..... H01R 9/0524 439/578
7,946,896 B2 5/2011 Waltz
7,963,811 B2 * 6/2011 Wason ..... H01R 9/2483 361/637
8,016,622 B2 9/2011 Battle
8,375,543 B1 * 2/2013 Balsells ..... 267/167
8,425,264 B2 * 4/2013 Michell ..... H01R 4/42 439/789
8,668,419 B2 3/2014 Hardt
8,727,818 B2 * 5/2014 Kossak ..... H01R 4/34 439/718
8,747,170 B2 * 6/2014 Cornelius ..... H01R 4/36 439/798
8,801,475 B2 * 8/2014 Maninchedda ..... H01R 4/36 439/814
8,987,595 B2 * 3/2015 Bumgarner ..... H01R 4/363 174/84 R
9,046,144 B2 6/2015 Love
9,366,282 B2 6/2016 Vallette et al.
2004/0067697 A1 * 4/2004 Zahnen ..... H01R 4/36 439/798
2005/0202732 A1 * 9/2005 Rizzo ..... H01R 4/36 439/810
2007/0026745 A1 * 2/2007 Ferretti ..... H01F 27/04 439/814
2008/0213040 A1 9/2008 Morze-Reichartz
2010/0120300 A1 * 5/2010 Battle ..... H01R 4/2408 439/798
2011/0318953 A1 12/2011 Battle
2014/0024241 A1 * 1/2014 Siebens ..... H01R 13/53 439/310
2015/0004843 A1 * 1/2015 Siebens ..... H01R 13/53 439/625
2015/0132979 A1 * 5/2015 Siebens ..... H01R 13/207 439/148

OTHER PUBLICATIONS

"Live Line Pigtail Connectors", Date Unknown but prior to Nov. 18, 2014, 6 pages.

* cited by examiner

ELECTRICAL CONNECTORS AND CONNECTION ASSEMBLIES AND METHODS INCLUDING THE SAME

FIELD OF THE INVENTION

The present invention relates to electrical cables and connections and, more particularly, to electrical connectors.

BACKGROUND OF THE INVENTION

Pin terminals or connectors are employed to provide convenient electrical connections between electrical components in electrical power distribution systems. For example, it is known to provide a pin terminal including an elongate stud and an integral connector body crimped onto the stud. An electrical power distribution cable may be terminated by securing a terminal end of the cable in the connector body. The cable can then be connected to another cable or electrical equipment by engaging the stud with a clamp, for example.

SUMMARY OF THE INVENTION

According to embodiments of the invention, an electrical connector for use with an electrical conductor having a terminal end includes a connector body and a stud member. The connector body includes a conductor engagement section and a stud mounting section. The conductor engagement section is configured to receive the terminal end of the conductor to mechanically and electrically connect the conductor to the connector. The stud mounting section includes a socket bore including a tapered bore section. The stud member includes an elongate stud section extending to a free end, and a tapered insert section. The tapered insert section is received in the tapered bore section. The tapered insert section includes an internal cavity defined therein to permit deformation of the tapered insert section as the tapered insert section is forced into the tapered bore section.

According to method embodiments of the invention, a method for forming an electrical connector for use with an electrical conductor having a terminal end includes providing a connector body including: a conductor engagement section configured to receive the terminal end of the conductor to mechanically and electrically connect the conductor to the connector; and a stud mounting section including a socket bore including a tapered bore section. The method further includes providing a stud member including: an elongate stud section extending to a free end; and a tapered insert section including an internal cavity defined therein. The method further includes forcibly inserting the tapered insert section into the tapered bore section, wherein the internal cavity permits deformation of the tapered insert section as the tapered insert section is forced into the tapered bore section.

According to embodiments of the invention, an electrical connector for use with an electrical conductor having a terminal end includes a connector body and a stud member. The connector body includes a conductor engagement section and a stud mounting section. The conductor engagement section is configured to receive the terminal end of the conductor to mechanically and electrically connect the conductor to the connector. The stud mounting section includes a first threaded section. The stud member includes an elongate stud section extending to a free end. The stud member further includes a second threaded section threadedly engaging the first threaded section to secure the stud member to the connector body.

According to embodiments of the invention, an electrical connector for use with an electrical conductor having a terminal end includes a connector body and a stud member. The connector body includes a conductor engagement section including a conductor bore configured to receive the terminal end of the conductor. The stud member includes a mounting section secured to the connector body, and an elongate stud section extending from the mounting section to a free end. The connector further includes at least one shear bolt mounted in the connector body and configured to clamp the conductor in the conductor bore to mechanically and electrically connect the conductor to the connector.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
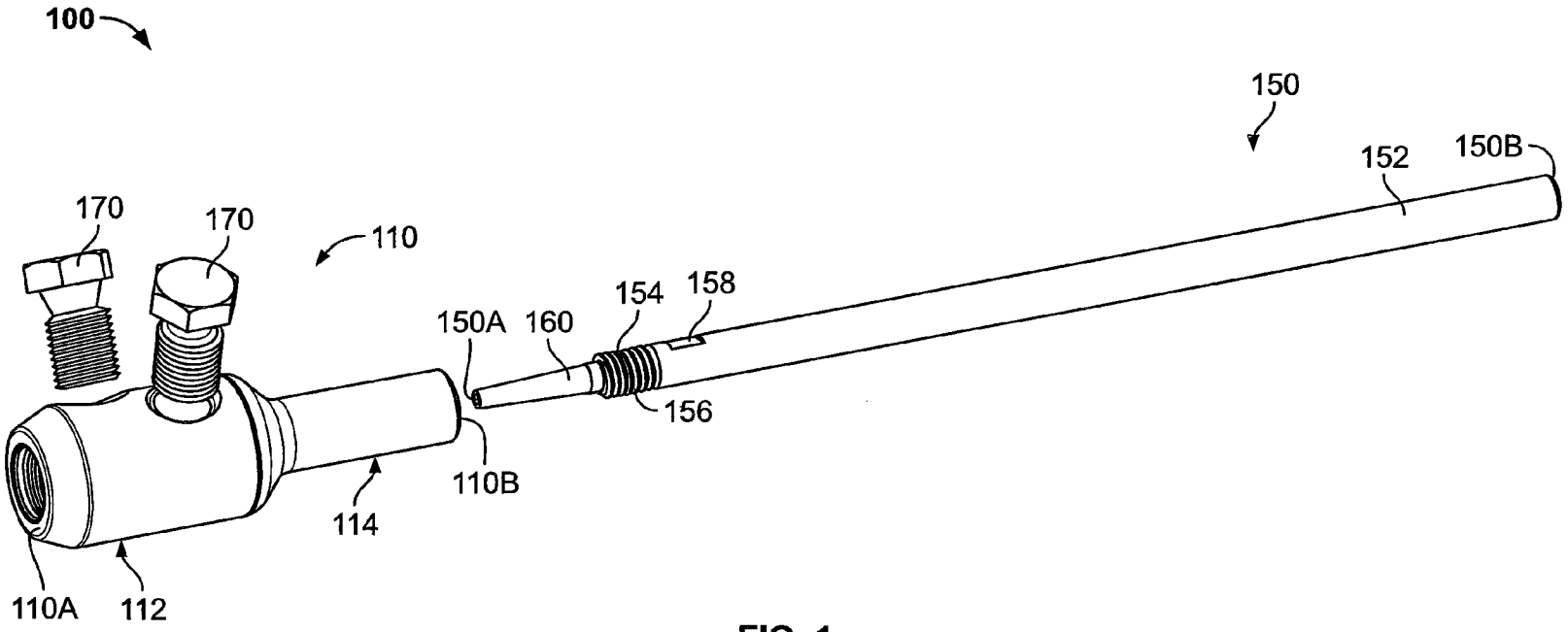
FIG. 1 is an exploded, front perspective view of an electrical connector according to embodiments of the invention.
Figure 2:
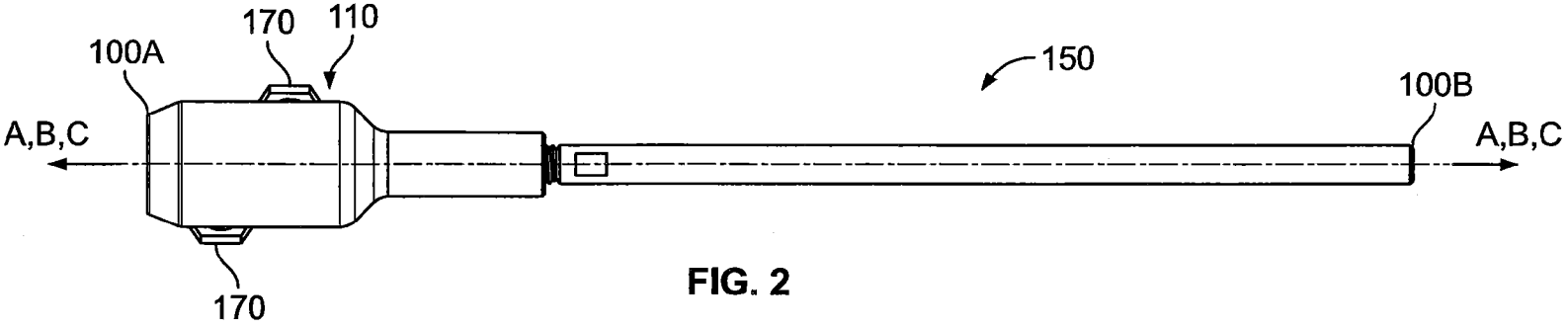
FIG. 2 is a bottom view of the electrical connector of FIG. 1.
Figure 3:
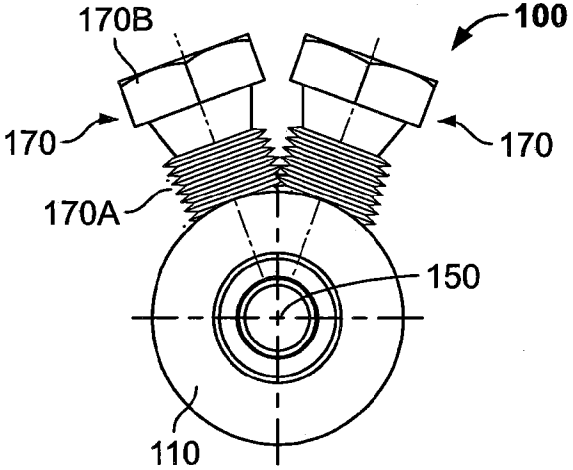
FIG. 3 is a rear end view of the electrical connector of FIG. 1.
Figure 4:
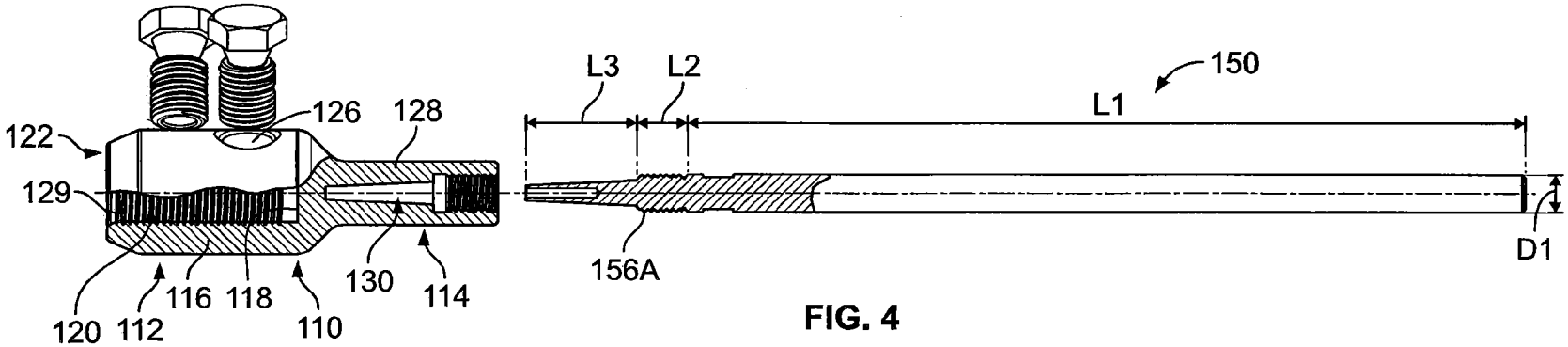
FIG. 4 is an exploded, fragmentary, side view of the electrical connector of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-7, an electrical pin terminal or electrical connector 100 according to embodiments of the present invention is shown therein. The connector 100 can be used to construct a terminated conductor 25 (FIG. 7) and a connection assembly 10 according to some embodiments of the present invention. The connection assembly 10 can be used to form a mechanical and electrical connection 12 between an electrical cable conductor 20 and electrical equipment 40 such as an electrical power transformer, for example. In some embodiments, the connector 100 is provided with an electrically insulating cover 30 to environmentally protect an end of the conductor 20.

In some embodiments, the connection assembly 10, conductor 20 and equipment 40 form a part of an electrical power distribution network or system 14. In some embodiments, the conductor 20 is a low or medium voltage (i.e., 15 to 35 kV) electrical power distribution cable. In some embodiments, the connection 12 is located overhead or underground in an electrical power distribution system.

The connector 100 includes a connector barrel or body 110, a stud member 150, and clamping bolts 170. The connector 100 may further include a corrosion inhibitor 172, a sealant 174, and a threadlock 176. The connector 100 defines a connector longitudinal axis A-A and extends from a first axial end 100A (hereinafter referred to as the front end) and an opposing second axial end 100B (hereinafter referred to as the rear end).

The connector body 110 is electrically conductive. The connector body 110 has axially opposed ends 110A and 110B defining a connector body axis B-B coaxial with the connector axis A-A. The connector body 110 includes a conductor engagement section 112 at the end 110A and a stud mounting section 114 at the end 110B.

The engagement section 112 includes a tubular, generally cylindrical side wall 116 and an end wall 118 defining a conductor bore 120. The conductor bore 120 communicates with a cable receiving opening 122 on the end 110A and extends generally coaxially with the axis B-B. Threaded bolt bores 126 extend radially through the side wall 116 and intersect the conductor bore 120. The conductor bore 120 is configured to receive a terminal segment of the cable conductor 20. The conductor engagement section 112 has a generally cylindrical outer surface. Threads 129 or other retention features may be provided on the inner surface of the side wall 116 to help secure the conductor 20.

The stud mounting section 114 includes a tubular, generally cylindrical side wall 128. The side wall 128 and an end wall 144 define a socket bore 130. The socket bore 130 communicates with a stud receiving opening 132 on the end 110B and extends generally coaxially with the axis B-B. The socket bore 130 includes (sequentially from the opening 132 to the end wall 144) a threaded section 134, a thread relief section 136, and a tapered bore section 140. The threaded section 134 includes an internal helical thread 134A. The thread relief section 136 includes an undercut having a larger inner diameter than the threaded section 134 (i.e., greater than the major diameter or root of the thread 134A). An annular ledge 136A is located between the thread relief section 136 and the tapered bore section 140. A frustoconical inner contact surface 142 defines the tapered bore section 140 of the socket bore 130.

According to some embodiments and as shown, the connector 100 is a shear bolt connector and the each conductor clamp bolt 170 is a frangible shear bolt. Each shear bolt 170 includes a shank 170A and a head 170B. The head 170B is configured to operatively engage a driver tool. The shank 170A has an external thread complementary to the thread of the bores 126. The shank 170A is configured such that the head 170B will shear off of a remainder of the associated bolt 170 (i.e., the threaded shank) when subjected to a prescribed torque. In some embodiments, the bolt 170 is configured such that the shank 170A will shear off at or proximate the outermost thread of the bore 126 when the bolt 170 is subjected to the prescribed torque.

The stud member 150 is electrically conductive. The stud member 150 is elongate and has axially opposed ends 150A and 150B defining a stud axis C-C coaxial with the connector axis A-A. The stud member 150 includes (sequentially from the free end 150B to the end 150A) a stud section 152, a threaded section 154, and a head or tapered insert section 160.

The stud section 152 may be substantially cylindrical and elongate. A driver engagement feature in the form of opposed flats 158 is formed on the stud section 152 adjacent the threaded section 154. In some embodiments, the stud section 152 has a length L1 (FIG. 4) in the range of from about 11 to 13 inches. In some embodiments, the stud section 152 has a diameter D1 (FIG. 4) in the range of from about 0.25 to 0.625 inch. In some embodiments, the ratio of the length L1 to the diameter D1 is in the range of from about 15 to 60.

The threaded section 154 includes an external thread 156 extending to a thread lead end 156A. In some embodiments, the axial length L2 (FIG. 4) of the thread 156 is in the range of from about 0.4 to 1 inch.

The tapered insert section 160 has a frustoconical outer contact surface 160A that tapers from proximate the threaded section 154 to the end 150A. An internal bore 162 extends axially through the tapered insert section 160 from the end 150A to an end wall 162B and communicates with an end opening 162A. The internal bore 162 and the outer contact surface 160A define a tubular compression wall 164 radially therebetween.

According to some embodiments, the length L3 of the tapered insert section 160 is in the range of from about 0.8 to 2 inches and, in some embodiments, in the range of from about 0.5 to 2.5 inches.

According to some embodiments, the length L4 (FIG. 6) of the internal bore 162 is in the range of from about 0.4 to 1.6 inches. According to some embodiments, the diameter D2 (FIG. 6) of the internal bore 162 is in the range of from about 0.08 to 0.25 inch. According to some embodiments, the radial thickness T1 (FIG. 6) of the compression wall 164 is in the range of from about 0.02 to 0.12 inch.

Figure 5:
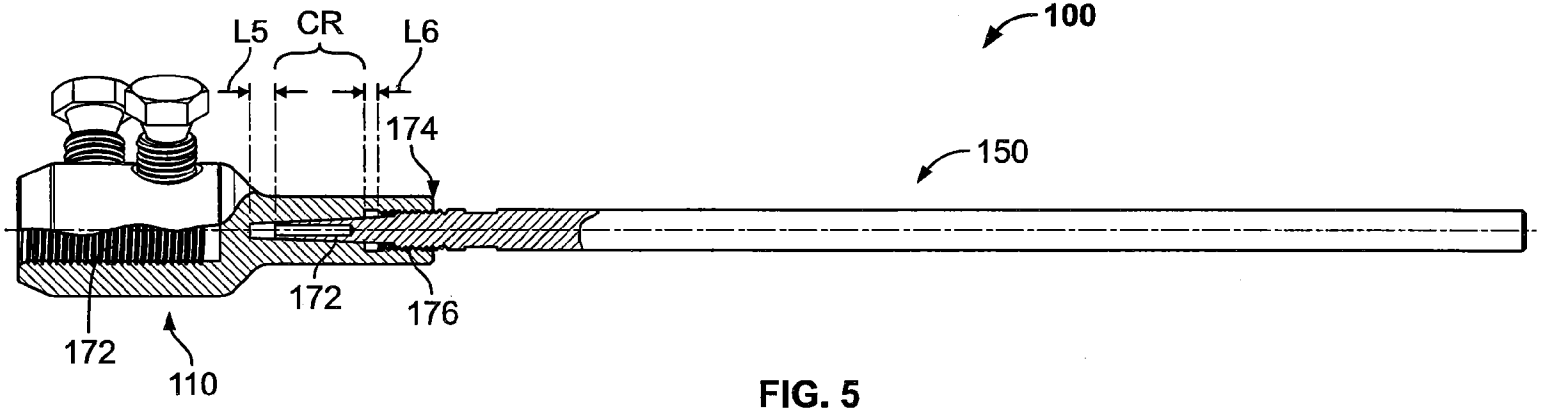
FIG. 5 is a fragmentary, side view of the electrical connector of FIG. 1.
Figure 6:
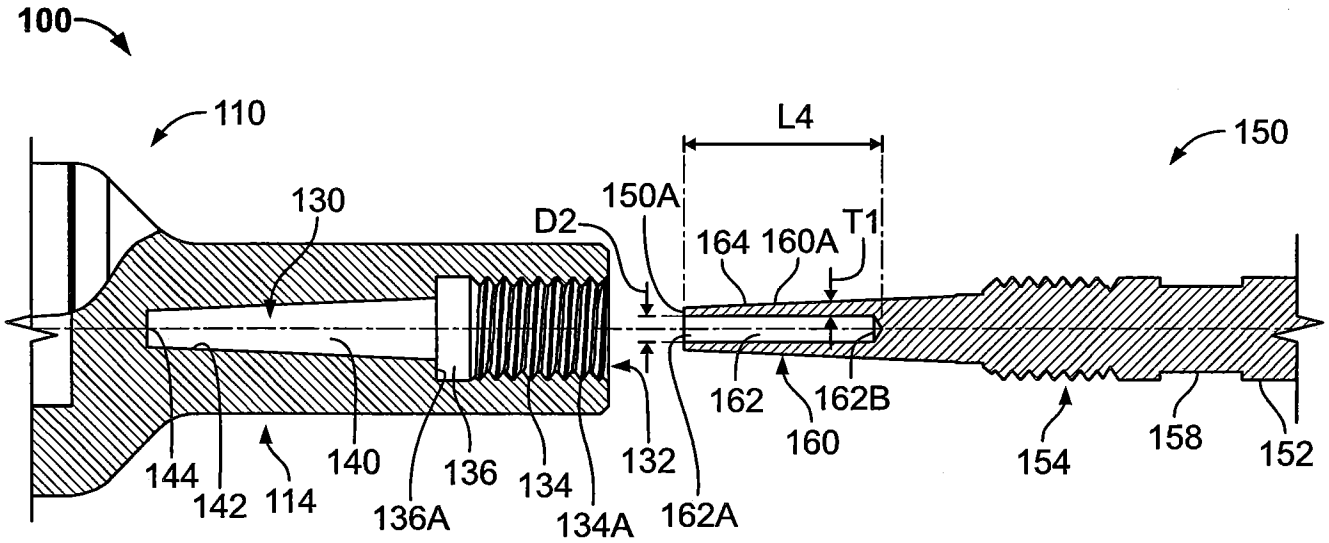
FIG. 6 is an enlarged, exploded, fragmentary, side view of the electrical connector of FIG. 1.
Figure 7:
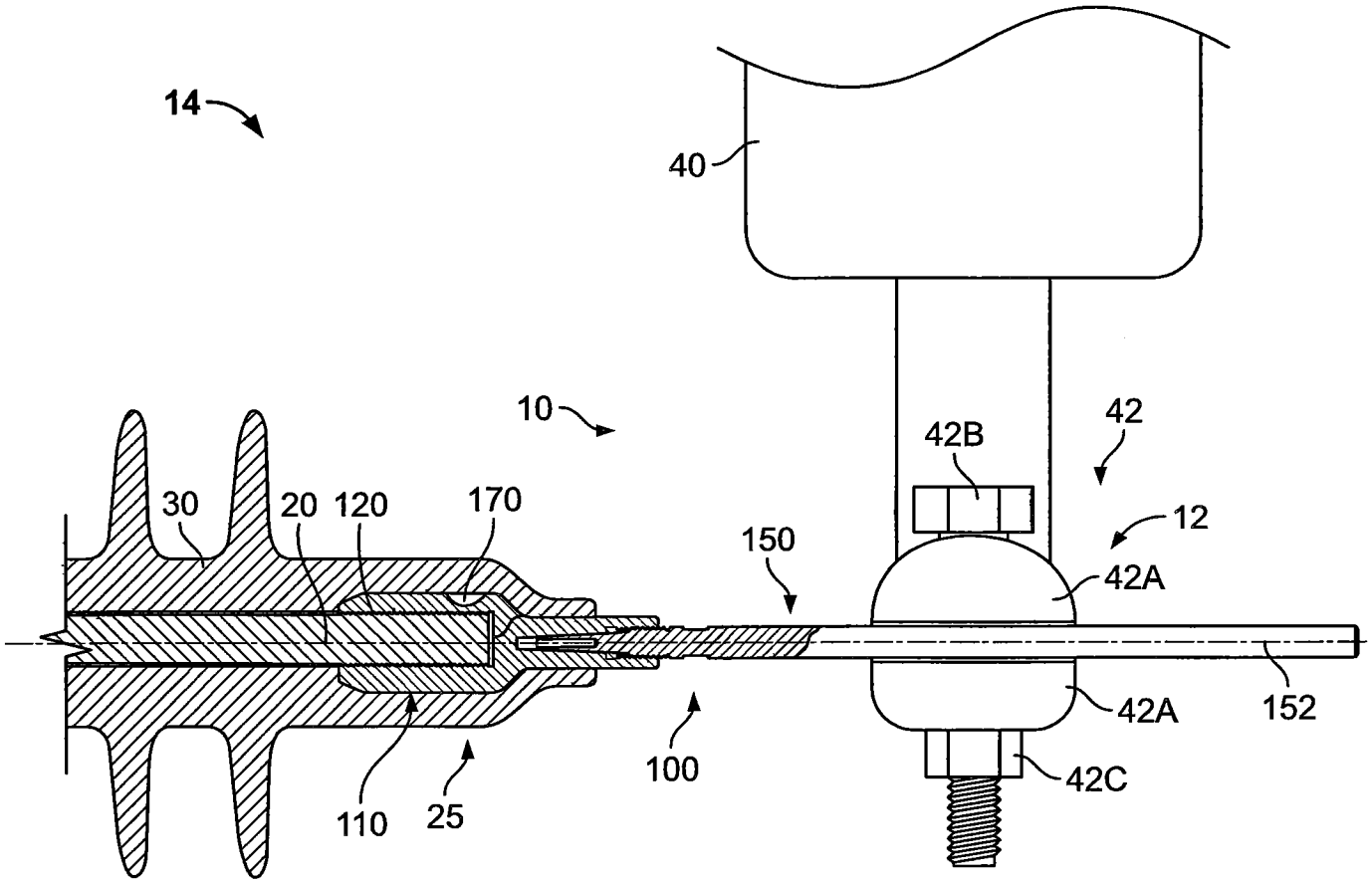
FIG. 7 is a side view of an electrical power distribution system including the electrical connector of FIG. 1.

According to some embodiments, the taper angle of the contact surface 160A is in the range of from about 1 to 4 degrees to the longitudinal axis A-A (i.e., the angle between opposed sides of the tapered surface 160A is in the range of from about 2 to 8 degrees). In some embodiments, the taper angle of the contact surface 142 defining the tapered bore section 140 of the socket bore 130 is within about 0.5 degrees of the taper angle of the contact surface 160A and, in some embodiments, is substantially the same. According to some embodiments, the respective geometries of the contact surface 160A and the contact surface 142 are such that, when the tapered section 160 is positioned at a prescribed depth into the socket bore 130 as shown in FIG. 5, the outer diameter and shape of the contact surface 160A are substantially the same as the inner diameter and shape of the contact surface 142 at least throughout a prescribed contact region CR (FIG. 5).

The connector body 110 and the stud member 150 are discrete members that are assembled to one another to form a unitary assembly. More particularly and as discussed in more detail below, the end sections 154, 160 of the stud member 150 are rigidly captured in the socket bore 130 to provide a mechanical and electrical connection therebetween. The cable 20 can be secured in the conductor bore 120 by the bolts 170, and thereby mechanically and electrically connected to the stud section 152.

The connector body 110 and the stud member 150 may be formed by any suitable method. In some embodiments, the connector body 110 and the stud member 150 are machined. According to some embodiments, the connector body 110 and the stud member 150 are each monolithic.

The connector body 110 and the stud member 150 may be formed of any suitable electrically conductive material. According to some embodiments, the connector body 110 and the stud member 150 are each formed of metal and, in some embodiments, are each formed of steel, copper, brass or aluminum.

In some embodiments, the connector body 110 and the stud member 150 are formed of different metals from one another. Moreover, in some embodiments, the connector body 110 and the stud member 150 are each individually tin-plated. In particular, in some embodiments, the connector body 110 is formed of aluminum (which may include aluminum alloy) and the stud member 150 is formed of copper (which may include copper alloy). In some embodiments, the connector body 110 is formed of tin plated aluminum alloy and the stud member 150 is formed of tin plated copper (e.g., C11000 copper). The tin-plating can inhibit galvanic corrosion between the aluminum and copper components. In some embodiments, the copper is annealed after machining to the shape of the stud member 150 in order to soften the copper.

The corrosion inhibitor 172 may be any suitable flowable corrosion inhibitor, such as a neutral grease. Suitable corrosion inhibitor greases include grease available from TE Connectivity, for example.

The moisture sealant 174 may be any suitable moisture sealant, such as a flowable sealant that is cured (e.g., air cured) after application. Suitable sealants include one-part aluminum colored sealant available from 3M Corporation, for example.

The threadlock 176 may be any suitable flowable threadlock such as LOCTITE™ grade 263 threadlock available from Henkel of Germany.

The conductor 20 may be formed of any suitable electrically conductive materials such as copper (solid or stranded). The conductor 20 may be an uninsulated cable or may include a cable insulation layer or jacket (e.g., a polymeric insulation layer). According to some embodiments, the conductor 20 is a low-voltage or medium-voltage (i.e., between about 15 and 35 kV) power distribution cable and, in particular, may be a power distribution cable. The conductor 20 is exemplary and it will be appreciated that connectors as disclosed herein can be used with other types of conductors.

The connector 100 may be assembled as follows in accordance with methods of the present invention.

The shear bolts 170 are threaded into the bolt bores 126. The bolts 170 may be threaded only partly into the bores 126 in order to allow clearance for insertion of the conductor 20 into the conductor bore 120.

Corrosion inhibitor 172 may be applied to the surfaces of the conductor bore 120.

Corrosion inhibitor 172 is applied to the tapered section 160. Threadlock 176 is applied to the threads 156.

The tapered insert section 160 is then inserted into the socket bore 130 until the thread 156 engages the thread 134A. The stud member 150 is then rotated about the axes A-A, C-C to screw the tapered insert section 160 into the tapered bore section 140 of the socket bore 130. The stud member 150 may be rotated using a driver engaging the flats 158. According to some embodiments, the stud member 150 is screwed into the socket bore 130 until a prescribed torque is achieved.

When the stud member 150 screwed into the socket bore 130 to its final position as shown in FIG. 5, the end 150A of the stud member 150 is spaced apart from the end wall 144 a relief distance L5 (FIG. 5), and the thread lead end 156A is spaced apart from the ledge 136A a relief distance L6 (FIG. 5). In some embodiments, the relief distance L5 is at least about 0.15 inch. In some embodiments, the relief distance L6 is at least about 0.10 inch. The remaining volume of the thread relief section 136 may serve to collect excess corrosion inhibitor 172 that is displaced (e.g., wiped or extruded) from the tapered section 160 to prevent the corrosion inhibitor 172 from coating the threads 134A, 156.

As the tapered insert section 160 is progressively axially displaced relative to the connector body 110 into the tapered bore section 140 (i.e., in the direction of the end 100A), the contact surfaces 160A and 142 engage one another over an increasing length. Friction between the contact surfaces 160A, 142 is thereby progressively increased. This frictional engagement serves to friction fit or press fit the tapered insert section 160 into the tapered bore section 140, and to resist relative rotation and relative axial displacement between the connector body 110 and the stud member 159.

Moreover, as the tapered insert section 160 is progressively axially displaced relative to the connector body 110 into the tapered bore section 140, the side wall 128 of the connector body 110 radially compresses the tapered insert section 160, causing the side wall 164 thereof to radially deform. This deformation causes the contact surface 160A to better conform to the contact surface 142, providing increased friction and physical and electrical contact area or points between the contact surfaces 160A, 142. According to some embodiments, the radial deformation of the contact surface 160A is less than 1 mm and, in some embodiments, less than 0.5 mm. According to some embodiments, the radial deformation of the contact surface 160A is at least 0.003 inch. In some embodiments, the radial deformation of the contact surface 160A is in the range of from about 0.003 to 0.01 inch.

The sealant 174 may be applied to the connector body 110 and the stud member 150 at their interface about the opening 132 after the stud member 150 has been installed in the socket bore 130.

The assembled connector 110 may be installed on a terminal end of the conductor 20 to form the terminated conductor 25. The end of the conductor 20 is inserted through the opening 122 into the conductor bore 120. The shear bolts 170 are rotated and torqued using a suitable driver (e.g., an electrically insulated powered or non-powered driver including a drive socket to operatively receive and engage the heads 170B of the bolts 170) until the heads 170B thereof shear or break off of the shanks 170A at a prescribed load. The conductor 20 is thereby electrically connected to the connector body 110 and mechanically clamped in the bore 120, and the remaining portions of the bolts 170 are slightly below or approximately flush with the outer surface of the connector body 110. The connector 100 and the conductor 20 may then be covered by a cold-shrink or heat-shrinkable cover (e.g., the cover 30).

The terminated conductor 25 may be connected to any suitable cooperating connector to form an electrical connection. For example, in the illustrated embodiment, the electrical equipment 40 includes a clamp connector 42. The clamp connector 42 includes opposed, relatively displaceable jaws 42A that are forced together using a bolt 42B and cooperating nut 42C to grab onto the stud section 152. In this manner a mechanical and electrical connection is formed between the equipment 40 and the conductor 20 through the connector 100.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An electrical connector for use with an electrical conductor having a terminal end, the electrical connector comprising:

a connector body including:

a conductor engagement section configured to receive the terminal end of the conductor to mechanically and electrically connect the conductor to the connector; and a stud mounting section including a socket bore including a tapered bore section; and a stud member including:

an elongate stud section extending to a free end; and a tapered insert section received in the tapered bore section, the tapered insert section including an internal cavity defined therein to permit deformation of the tapered insert section as the tapered insert section is forced into the tapered bore section.

2. The electrical connector of claim 1 wherein:

the stud mounting section includes a first threaded section; and the stud member includes a second threaded section threadedly engaging the first threaded section to secure the stud member to the connector body.

3. The electrical connector of claim 2 wherein the stud mounting section includes a thread relief bore section between the first threaded section and the tapered bore section.

4. The electrical connector of claim 2 wherein the stud member includes a driver engagement feature configured to be engaged by a driver to apply a torque to the stud member.

5. The electrical connector of claim 2 including a threadlock between the first and second threaded sections.

6. The electrical connector of claim 1 wherein a taper angle of the tapered insert section is substantially the same as a taper angle of the tapered bore section.

7. The electrical connector of claim 1 including a corrosion inhibitor between a contact surface of the tapered insert section and a mating contact surface of the stud mounting section defining the tapered bore section.

8. The electrical connector of claim 1 including a sealant between the stud mounting section and the stud member at an opening of the socket bore to inhibit ingress of moisture into the socket bore.

9. The electrical connector of claim 1 wherein the connector body is formed of aluminum and the stud member is formed of copper.

10. The electrical connector of claim 1 wherein:

the conductor engagement section includes a conductor bore configured to receive the terminal end of the conductor; and the connector further includes at least one shear bolt mounted in the connector body and configured to clamp the conductor in the conductor bore to mechanically and electrically connect the conductor to the connector.

11. The electrical connector of claim 1 wherein:

the stud mounting section includes a first threaded section;

the stud member includes a second threaded section threadedly engaging the first threaded section to secure the stud member to the connector body;

the stud mounting section includes a thread relief bore section between the first threaded section and the tapered bore section;

a taper angle of the tapered insert section is substantially the same as a taper angle of the tapered bore section;

the electrical connector includes a corrosion inhibitor between a contact surface of the tapered insert section and a mating contact surface of the stud mounting section defining the tapered bore section;

the connector body is formed of aluminum and the stud member is formed of copper;

the conductor engagement section includes a conductor bore configured to receive the terminal end of the conductor; and the connector further includes at least one shear bolt mounted in the connector body and configured to clamp the conductor in the conductor bore to mechanically and electrically connect the conductor to the connector.

12. A method for forming an electrical connector for use with an electrical conductor having a terminal end, the method comprising:

providing a connector body including:

a conductor engagement section configured to receive the terminal end of the conductor to mechanically and electrically connect the conductor to the connector; and a stud mounting section including a socket bore including a tapered bore section; and providing a stud member including:

an elongate stud section extending to a free end; and a tapered insert section including an internal cavity defined therein; and forcibly inserting the tapered insert section into the tapered bore section, wherein the internal cavity permits deformation of the tapered insert section as the tapered insert section is forced into the tapered bore section.

13. The method of claim 12 wherein:

the stud mounting section includes a first threaded section;

the stud member includes a second threaded section;

the method includes threadedly engaging the first threaded section with the second threaded section; and the step of forcibly inserting the tapered insert section into the tapered bore section includes forcibly rotating the stud member and the connector body relative to one another.

14. The method of claim 13 including applying a threadlock between the first and second threaded sections.

15. The method of claim 12 wherein a taper angle of the tapered insert section is substantially the same as a taper angle of the tapered bore section.

16. The method of claim 12 including applying a corrosion inhibitor to a contact surface of the tapered insert section such that the corrosion inhibitor is disposed between the contact surface of the tapered insert section and a mating contact surface of the stud mounting section defining the tapered bore section when the tapered insert section is installed in the tapered bore section.

17. The method of claim 12 including applying a sealant between the stud mounting section and the stud member at an opening of the socket bore to inhibit ingress of moisture into the socket bore.

18. The method of claim 12 wherein the connector body is formed of aluminum and the stud member is formed of copper.

19. The method of claim 12 wherein:

the conductor engagement section includes a conductor bore configured to receive the terminal end of the conductor; and the connector further includes at least one shear bolt mounted in the connector body and configured to clamp the conductor in the conductor bore to mechanically and electrically connect the conductor to the connector.

* * * * *